US007954197B2

(12) United States Patent
Lindner et al.

(10) Patent No.: US 7,954,197 B2
(45) Date of Patent: Jun. 7, 2011

(54) MOP-HEAD PLATE COMPRISING MOP COVER

(75) Inventors: Falk Lindner, Hemsbach (DE); Andreas Eisenhut, Heidelberg (DE); Michael Masih, Weinheim (DE); Torsten Gratzki, Essen (DE)

(73) Assignee: Carl Freudenberg, Kg, Weinheim (DE)

( * ) Notice: Subject to any disclaimer, the term of this patent is extended or adjusted under 35 U.S.C. 154(b) by 1079 days.

(21) Appl. No.: 11/597,176

(22) PCT Filed: Mar. 16, 2005

(86) PCT No.: PCT/EP2005/002769

§ 371 (c)(1),
(2), (4) Date: Apr. 23, 2007

(87) PCT Pub. No.: WO2005/117678

PCT Pub. Date: Dec. 15, 2005

(65) Prior Publication Data

US 2008/0010773 A1 Jan. 17, 2008

(30) Foreign Application Priority Data

May 28, 2004 (DE) ..... 10 2004 026 839

(51) Int. Cl.
*A47L 13/20* (2006.01)

(52) U.S. Cl. ..... 15/228; 15/231

(58) Field of Classification Search ..... 15/231, 15/228

See application file for complete search history.

(56) References Cited

U.S. PATENT DOCUMENTS

| | | | | |
|---|---|---|---|---|
| 3,411,173 | A * | 11/1968 | Berrington et al. | 15/231 |
| 4,991,250 | A * | 2/1991 | Young | 15/228 |
| 2001/0013153 | A1 | 8/2001 | Zorzo | |

FOREIGN PATENT DOCUMENTS

| | | | |
|---|---|---|---|
| DE | 37 14 178 | A1 | 2/1988 |
| DE | 10000392 | A1 | 5/2001 |
| DE | 201 06 432 | U1 | 8/2001 |
| WO | WO 91/16849 | A1 | 11/1991 |

* cited by examiner

*Primary Examiner* — Laura C Guidotti
(74) *Attorney, Agent, or Firm* — Leydig, Voit & Mayer, Ltd.

(57) ABSTRACT

The invention relates to a mop (1) comprising a mop-head plate (2) and an interchangeable mop cover (3) with a mopping surface (4) that is attached to the mop-head plate (2). According to the invention, the mop cover (3) is equipped on two opposing sides with a respective fixing device (5), which engages in a respective retainer (6) of the mop-head plate (2). At least one retainer (6) is formed by a recess (7) and the corresponding fixing device (5) is held by a positive fit in the recess (7) so that it can be detached without sustaining any damage.

8 Claims, 5 Drawing Sheets

MOP-HEAD PLATE COMPRISING MOP COVER

TECHNICAL FIELD

The invention concerns a mop consisting of a mop plate and a mop cover having a mop surface that is exchangeably affixed to the mop plate, where the mop cover has a securing device at each of its two opposite sides, each of which engages with a recess in the mop plate.

PRIOR ART

A mop with a mop plate on which a mop cover can be separably affixed is known from DE 37 45 013 C2. The attachment is done by clamping the ends of the material that are formed as a continuation of the material. Clamping takes place by means of hinged straps that are arranged on the side of the mop plate away from the mop surface. The clamping effect is determined by the thickness of the material of the material ends. The holding power of the connection is determined by the material thickness of the material end and for this reason can vary.

A clamp connection is difficult to open and harbors the danger of injury if the clamping force is great. Movable parts are necessary for the clamp connection, so that there is increased danger of breakage.

DESCRIPTION OF THE INVENTION

The invention is based on the task of making a farther development in the known mop so that the mop cover can be exchanged with little effort and is reliably held on the mop plate during mopping, This task is solved by the characteristics of Claims 1 and 7. The dependent claims refer to advantageous embodiments.

To solve the task, at least one receptacle in the mop plate is formed by a recess and the corresponding holding device is disposed in the recess in a positive locking fashion (form-fitted) and can be nondestructively removed. Through the positive locking connection of the holding device of the mop cover and the recess of the mop plate, the mop cover is more reliably affixed to the mop plate during mopping and wringing. Because of the form-fit, only low attachment force is necessary for a reliable connection. Through the low forces of attachment and the absence of moving parts for attachment changing the mop cover becomes simpler and the danger of injury decreases. The mop plate and mop cover have few parts and can be produced simply and cheaply.

The recess can be disposed on the side of the mop plate turned away from the mopping surface. With this arrangement the mop cover can be affixed to the mop plate especially easily.

The receptacle can be formed by a slot disposed on a transverse edge and open to a lengthwise edge of the mop plate and extending parallel to the mop plate, and an undercut ending at the side of the slot turned toward the transverse edge and open to the lengthwise edge. The slot makes insertion of the mop cover up to the transverse edge of the mop plate more reliable, especially when mopping in the lengthwise direction. The positive lock of the mop cover in the mop plate takes place by means of the undercut. The slot and the rectangular undercut can be made simply and cheaply. No moving parts are necessary for attachment of the mop cover.

In one design a pin running parallel to the transverse edge can be arranged in the undercut to receive the holding device of the mop cover. The pin allows a positive lock connection of mop cover and mop plate that is an alternative to the rectangular undercut.

The pin can have a thickening at its free end. The mop cover is held more reliably on the pin by the thickening.

Both receptacles can be each formed by a recess on the side of the mop plate turned away from the mopping surface, and an appropriate holding device can be disposed in the corresponding recess in a positive locking manner and nondestructively removable. In this way the mop cover can be exchanged especially simply.

The receptacles can, looking at a top view, be disposed point symmetrically on the mop plate. A point symmetric arrangement increases the security of the connection of mop plate and mop cover, since the mop cover can be completely separated only if the attachment elements of the mop cover are moved in opposite directions.

The mop plate can be foldable along an axis that extends across or parallel to the lengthwise axis, By means of a foldable mop plate, the mop cover can be compressed in a funnel-shaped wringer device. It is not necessary to separate the mop cover from the mop plate for this.

The task is likewise solved by a mop cover where the holding devices are formed congruent to the receptacles and can be brought into engagement with them. Through the engagement of the holding devices in the receptacles a positive locking (form-fitting) connection of the mop plate and mop cover is made. Because of the form-fit only low holding force is necessary for a reliable connection. Through the low holding force and the lack of moving parts for attachment, the replacement of the mop cover becomes simpler and the danger of injury is reduced. The mop plate and mop cover have few parts and can be made simply and cheaply.

The holding device can be formed by a textile strip that is joined at one end to the mop cover and has a thickening at the other end.

In one embodiment the thickening can be formed by an additional body that is affixed to the textile strip. A stable positive locking connection with easy operation results from the additional body.

In another embodiment the thickening can be formed by a loop of the textile strips A loop can be made without the use of additional material.

A gripping tab can be arranged on the loop. The gripping tab improves the handling of the mop cover. Color-coding can be applied to the gripping tab to make it easier to distinguish on mop cover.

The mop cover can have a mopping surface on the top side and bottom side. Use of two sides can increase the useful life of the mop, and, for another thing, different mop cover surfaces can be specified for specific surfaces to be cleaned.

The textile strip can be designed to be at least partially elastic in the lengthwise direction. Since certain mop covers can stretch when wet, the tension keeps the mop cover from slipping during mopping.

BRIEF DESCRIPTION OF THE FIGURES

Some embodiment examples of the mop in accordance with the invention are explained in more detail below by means of the figures. Here, in each case in schematic representation.

REALIZATION OF THE INVENTION

Figure 1:
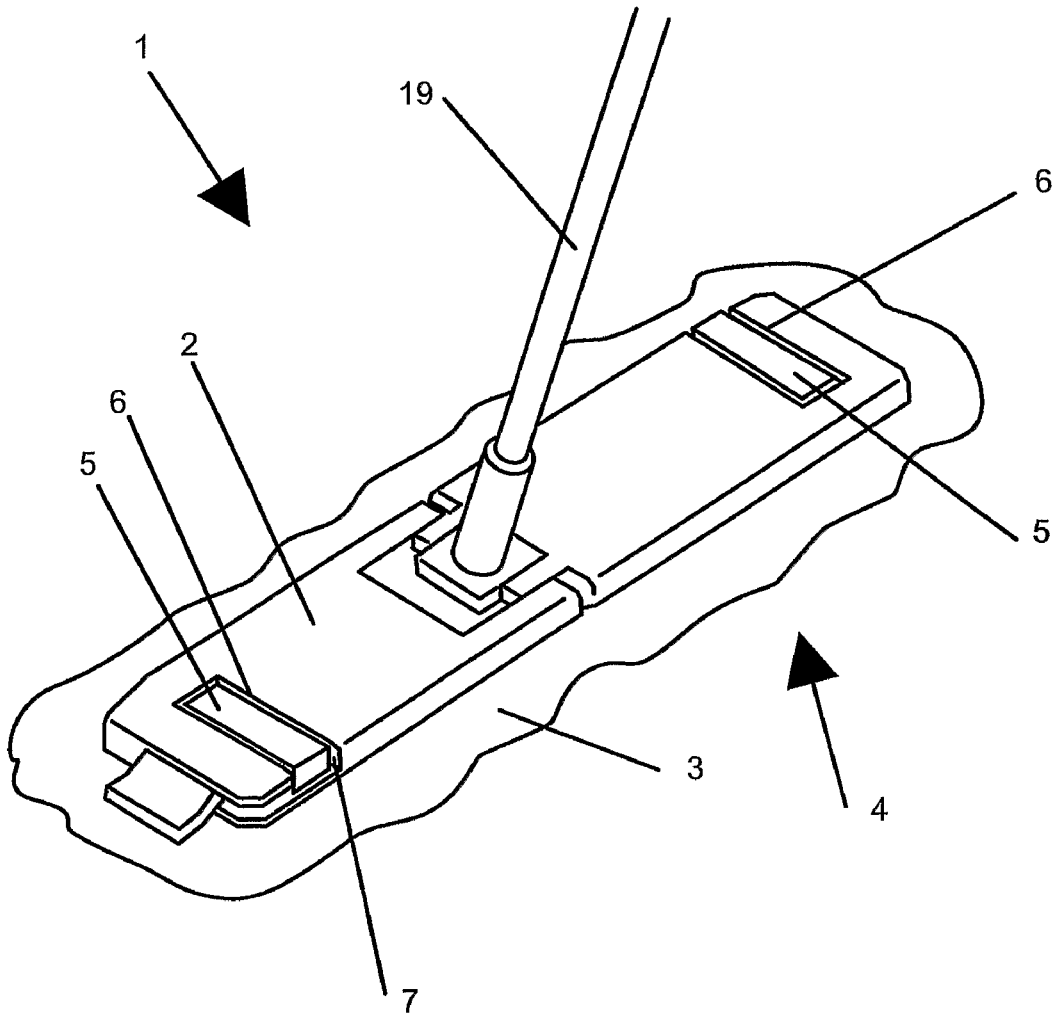
FIG. 1 shows the mop in accordance with the invention.

FIG. 1 shows a mop 1 with a mop plate 2 and a mop cover 3 with mop surface 4 exchangeably affixed to the mop plate 2. The mop plate 2 is hinged to a handle 19. The mop cover 3 has at each of its two opposite ends a holding device 5, each of which engages with a receptacle 6 in mop plate 2. The receptacles 6 in mop plate 2 are formed by recesses 7, which are arranged on the side of the mop plate turned away from the mopping surface 4. The holding devices 5 are arranged in recesses 7 in a positive locking fashion (form-fit) and can be removed nondestructively. The mop plate 2 is foldable along an axis that extends across its lengthwise axis.

Figure 2:
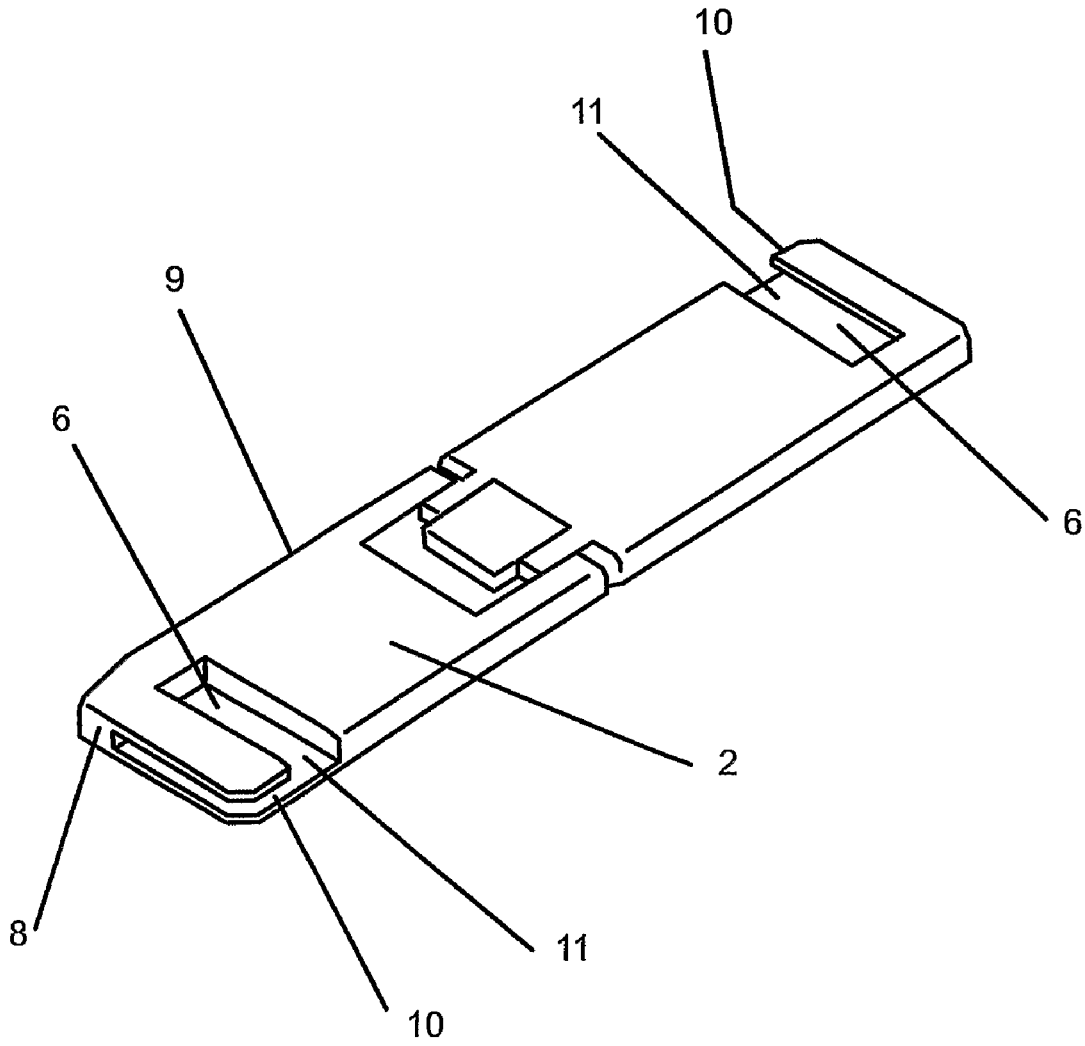
FIG. 2 shows a mop plate with a rectangular recess.

FIG. 2 shows a mop plate 2 with two receptacles 6, which are arranged on the sides turned away from the mopping surface 4. The receptacles 6 are formed by a slot 10 that is disposed on a transverse edge 8 and is open to a lengthwise edge 9 of the mop plate 2 and extends parallel to mop plate 2 and by a rectangular undercut 11 that is open to the lengthwise edge 9 and ends at the side of the slot 10 turned away from the transverse edge 8. The undercut 11 can also have a different shape. The receptacles 6, looking at a top view, arranged point-symmetrically on the mop plate 2. The mop plate 2 is foldable along an axis extending across its lengthwise axis. Alternatively, the mop plate can also be made foldable parallel to its lengthwise axis.

Figure 3:
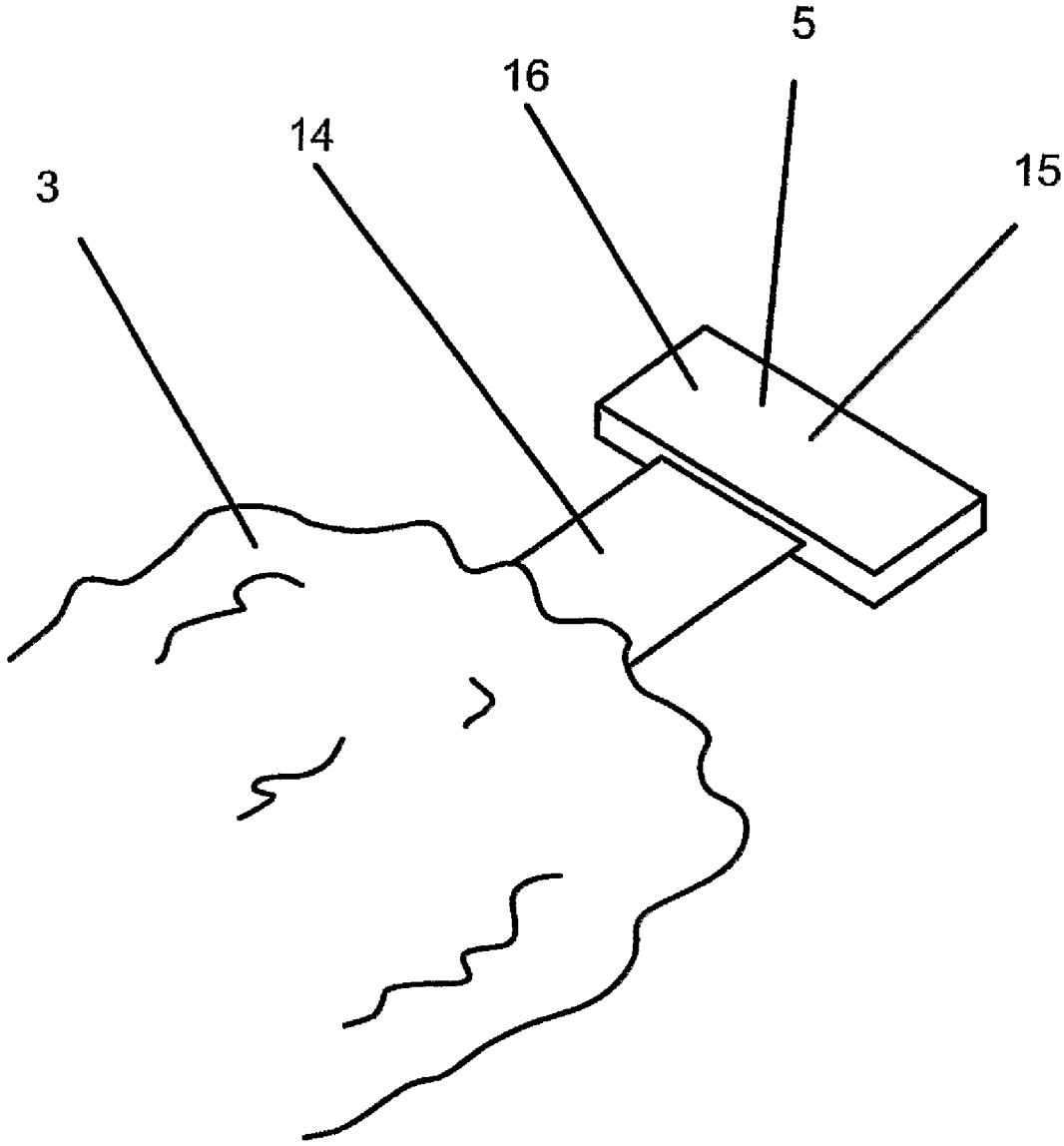
FIG. 3 shows a mop cover with a rectangular plastic body.

FIG. 3 shows a mop cover 3, which on two opposite ends has holding devices 5, which are designed to be congruent to the recesses 6 formed in accordance with FIG. 2. The holding devices 5 can be engaged in a positive locking fashion with recesses 6. The holding devices 6 are formed by textile strips 14 which are joined at one end to the mop cover 3 and at the other end have a thicker section 15. In this embodiment the thicker sections 15 are formed by rectangular plastic bodies 16, which are affixed to textile strips 14. The textile strips 14 are designed to be somewhat elastic in the lengthwise direction. The mop cover 3 has a mopping surface 4 on the top side and bottom side.

Figure 4:
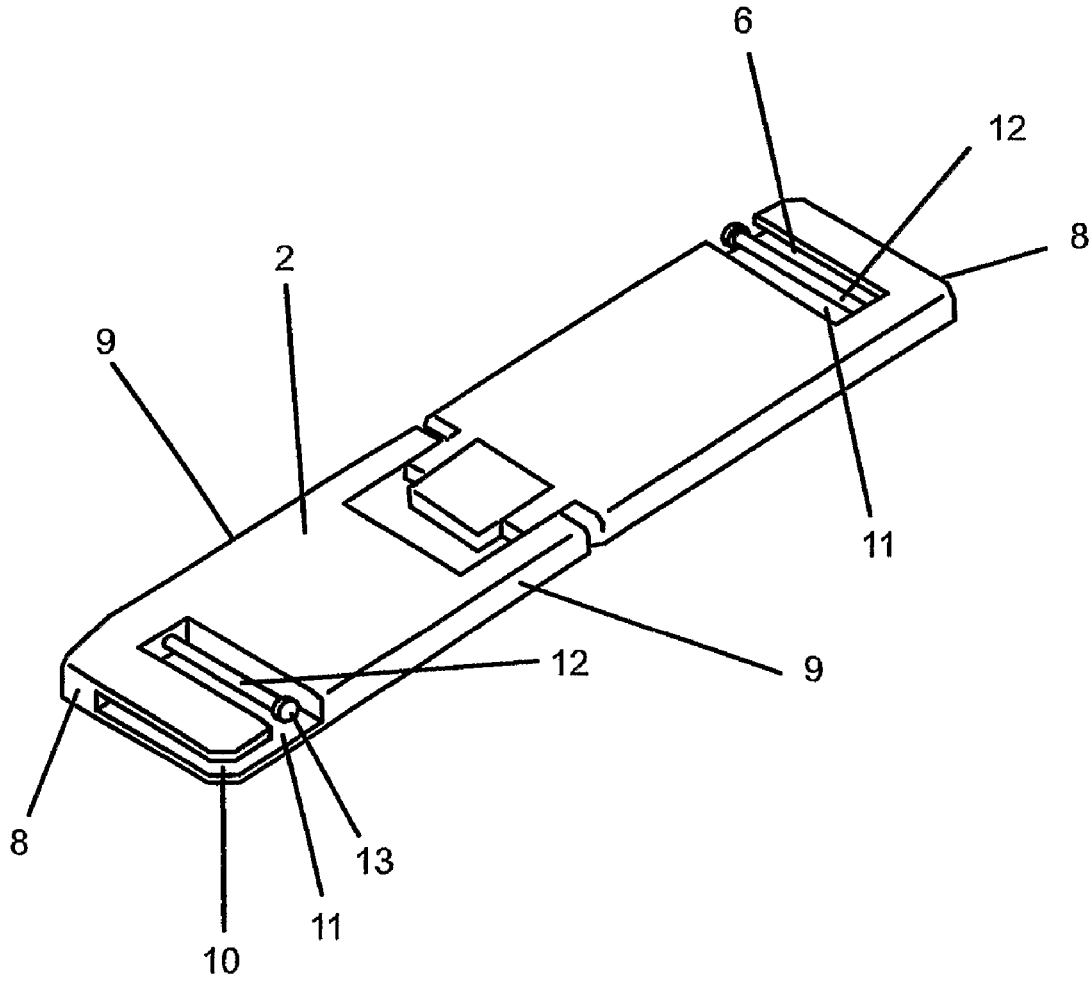
FIG. 4 shows a mop plate with a pin arranged in the recess.

FIG. 4 shows a mop plate 2 with two receptacles 6, which are disposed on the side turned away from the mopping surface 4. The receptacles 6 are formed by a slot 10 disposed at a transverse edge 8 and open to a lengthwise edge 9 of mop plate 2 and extending parallel to mop plate 2 and by a rectangular undercut 11 ending at the side of the slot 10 turned away from transverse edge 8 and open to the lengthwise edge 9. In the undercut 11 there is a pin 12 that runs parallel to transverse edge 8 to receive the holding device 5 of mop cover 3. Pin 12 has a thickening 13 at its free end. The receptacles 6, viewed from above, are disposed point symmetrically on mop plate 2. Mop plate 2 is foldable along an axis extending across its lengthwise axis.

Figure 5:
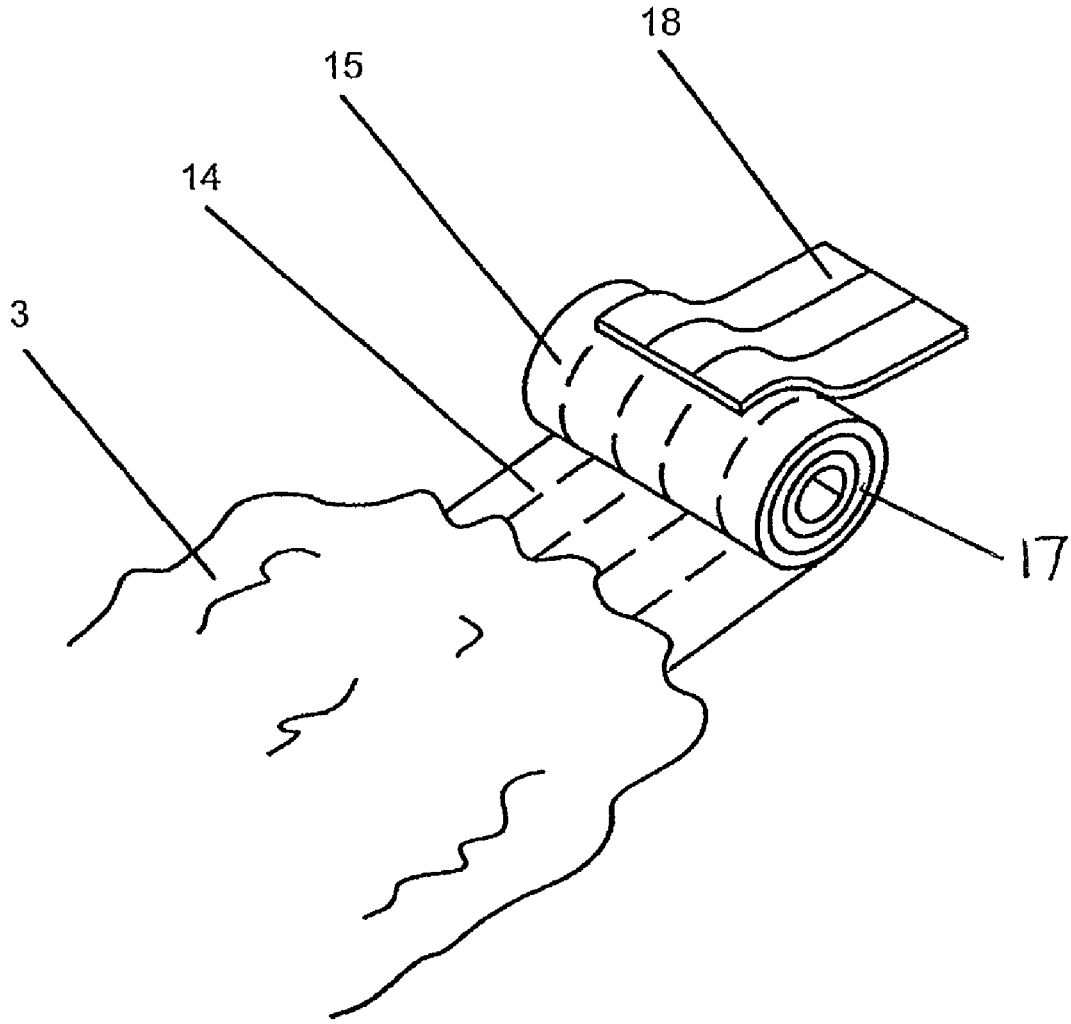
FIG. 5 shows a mop cover with a loop.

FIG. 5 shows a mop cover 3, which on two opposite sides has holding devices 5, which are designed to be congruent to the recesses 6 formed in accordance with FIG. 4. The holding devices 5 can be engaged in a positive lock with recesses 6. The holding devices 5 are formed by textile strips 14, which are joined at one end to the mop cover 3 and at the other end have a thickening 15. In this design the thickenings 15 are formed by loops 17 of the textile strip 14. The loops 17 can be engaged with the pins 12 of the mop plate in accordance with FIG. 4. The loops 17 are produced by rolling up and stitching the end of the textile strip 14 that is turned away from the mop cover 3. A gripping tab 18 is disposed on loop 17. The textile strips 14 are designed to be, in some cases, elastic in the lengthwise direction. The mop cover 3 can be used on both sides.

The invention claimed is:

1. A mop comprising a mop plate and a mop cover with a mopping surface that is exchangeably affixed to the mop plate, the mop cover has at each of its two opposite ends a holding device, each of which engages with a receptacle in the mop plate, at least one receptacle is formed by a recess comprising a slot in the mop plate that is open to and extends inward from a transverse edge of the mop plate and that is open to one of a lengthwise edge of the mop plate and a undercut in the mop plate and the corresponding holding device is disposed nondestructively separable and form fit in the recess.

2. A mop as in claim 1, wherein the recess is disposed on the side of the mop plate turned away from the mopping surface.

3. A mop as in claim 1, wherein the slot has a sidewall opposite the transverse edge of the mop plate from which the slot extends and wherein the undercut has an edge at the sidewall of the slot and is open to the lengthwise edge of the mop plate to which the slot is open.

4. A mop as in claim 3, wherein a pin to hold the holding device of the mop cover is disposed in the undercut parallel to the transverse edge of the mop plate from which the slot extends.

5. A mop as in claim 4, wherein the pin has a thickening at its free end.

6. A mop as in claim 1, wherein each receptacle is formed by a slot and an undercut in the mop plate.

7. A mop as in claim 1, wherein the receptacles, viewed from above, are disposed point symmetrically on the mop plate.

8. A mop as in claim 1, wherein the mop plate is foldable along an axis that extends across or parallel to a lengthwise axis.

* * * * *